US005989013A

United States Patent [19]

Gray

[11] Patent Number: 5,989,013

[45] Date of Patent: Nov. 23, 1999

[54] REVERBERATORY SCREEN FOR A RADIANT BURNER

[75] Inventor: Paul E. Gray, North East, Md.

[73] Assignees: AlliedSignal Composites Inc.; Lanxide Technology Company, LP

[21] Appl. No.: 08/789,236

[22] Filed: Jan. 28, 1997

[51] Int. Cl.[6] ..... F23D 3/40

[52] U.S. Cl. ..... 431/326; 431/328; 431/170; 501/95.2; 126/92 AC

[58] Field of Search ..... 431/326, 328, 431/329, 7, 170; 501/95.1, 95.2, 94; 126/92 AC; 428/141

[56] References Cited

U.S. PATENT DOCUMENTS

| | | | |
|---|---|---|---|
| 3,122,197 | 2/1964 | Saponara et al. | 431/329 |
| 3,169,572 | 2/1965 | Constance et al. | 158/116 |
| 3,303,869 | 2/1967 | Hayama . | |
| 3,659,579 | 5/1972 | Henderson et al. | 431/329 |
| 3,726,633 | 4/1973 | Vasilakis et al. . | |
| 3,847,536 | 11/1974 | Lepage . | |
| 3,857,670 | 12/1974 | Karlovetz et al. | 431/329 |
| 4,062,190 | 12/1977 | Dawson | 431/329 |
| 4,437,833 | 3/1984 | Mertz . | |
| 4,545,429 | 10/1985 | Place, Jr. et al. | 165/169 |
| 4,599,066 | 7/1986 | Granberg | 431/329 |
| 4,654,000 | 3/1987 | Smith | 431/328 |
| 4,799,879 | 1/1989 | Laspeyres | 431/328 |
| 4,851,375 | 7/1989 | Newkirk et al. | 501/88 |
| 4,977,111 | 12/1990 | Tong et al. | 501/95 |
| 5,026,273 | 6/1991 | Cornelison | 431/329 |
| 5,088,919 | 2/1992 | De Bruyne et al. | 431/328 |
| 5,090,898 | 2/1992 | Smith | 431/326 |
| 5,094,901 | 3/1992 | Gray | 428/141 |
| 5,165,887 | 11/1992 | Ahmady | 431/329 |
| 5,205,731 | 4/1993 | Reuther et al. | 431/328 |
| 5,224,856 | 7/1993 | Nakamura | 431/328 |
| 5,326,257 | 7/1994 | Taylor et al. . | |
| 5,346,389 | 9/1994 | Retallick et al. | 431/7 |
| 5,360,490 | 11/1994 | Nelson | 431/328 |
| 5,409,375 | 4/1995 | Butcher | 431/328 |
| 5,520,536 | 5/1996 | Rodgers et al. | 431/329 |
| 5,585,165 | 12/1996 | Kennedy et al. | 428/212 |
| 5,711,661 | 1/1998 | Kushch et al. | 431/329 |

FOREIGN PATENT DOCUMENTS

| | | |
|---|---|---|
| 0 539 278 | 10/1992 | European Pat. Off. . |
| 0 528 411 | 2/1993 | European Pat. Off. . |

*Primary Examiner*—Ira S. Lazarus
*Assistant Examiner*—Josiah C. Cocks
*Attorney, Agent, or Firm*—Larry J. Palguta; Jeffrey R. Ramberg

[57] ABSTRACT

The present invention relates to porous mat gas fired radiant burner panels utilizing improved reverberatory screens. The purpose of these screens is to boost the overall radiant output of the burner relative to a burner using no screen and the same fuel-air flow rates. In one embodiment, the reverberatory screen is fabricated from ceramic composite material, which can withstand higher operating temperatures than its metallic equivalent. In another embodiment the reverberatory screen is corrugated. The corrugations add stiffness which helps to resist creep and thermally induced distortions due to temperature or thermal expansion coefficient differences. As an added benefit, it has been unexpectedly discovered that the corrugations further increase the radiant efficiency of the burner. In a preferred embodiment, the reverberatory screen is both corrugated and made from ceramic composite material.

17 Claims, 6 Drawing Sheets

REVERBERATORY SCREEN FOR A RADIANT BURNER

The Government of the United States of America has rights in this invention pursuant to Contract No. DE-FC02-92CE40999 awarded by the U.S. Department of Energy.

FIELD OF THE INVENTION

This invention relates to porous mat, gas-fired radiant burner panels utilizing improved reverberatory screens. The purpose of these screens is to boost the overall radiant output of the burner relative to a burner using no screen and the same fuel-air flow rates. Alternatively, radiant burner screens permit the burner panel to be operated at reduced fuel consumption rate, lowering the temperature of the porous mat, thereby extending its life.

BACKGROUND OF THE INVENTION

Porous gas fired radiant burners have been in use for many years. The burners are an inexpensive source of radiant energy when compared to comparable units utilizing electric resistance heating. These burners are used in numerous industrial applications such as paint and paper drying. Additional applications include, for example, the heating of breezeways in colder climates.

The burner consists of a porous plate acting as one side of a box. The other five sides act as a plenum chamber to divert a mixture of gaseous fuel and air through the porous plate. The fuel-air mixture is ignited at the surface of the porous plate and combustion proceeds at the plate surface. The pore structure of the plate is fine enough to prevent flashback of the burning fuel-air mixture into the plenum chamber. FIG. 8 illustrates such a burner.

As surface combustion proceeds, the surface temperature of the plate rises. The ultimate temperature the porous plate attains depends on the plate thickness, its porosity and the amount of fuel-air mixture flowing through it. The amount of radiant heat produced by such a plate is proportional to its surface temperature. Unfortunately, many of the materials used to fabricate these porous burner surfaces will not withstand the higher operating temperature imposed by running the burner at high surface temperatures to achieve higher radiant output.

Assuming complete combustion (and ignoring conductive heat transfer), the available heat produced for a given quantity of fuel-air is the sum of the radiant and convective energy fractions. Placing of a refractory screen or grid at a short distance from the porous plate burner surface has been a common way to boost the radiant output of the burner by converting some of the convective energy into radiant energy. This phenomenon is termed a "reverberatory" effect; thus, such screens are reverberatory screens. This allows the burner surface temperature to be reduced for a given radiant output, greatly increasing the useful life of the porous burner panel. Further, the presence of such a reverberatory screen permits the radiant burner to be operated more efficiently. Specifically, some of the convective heat energy which might otherwise be lost (hot air rises) is converted to radiant energy, which is more easily directed to where it is needed.

The reverberatory screen is prone to the deleterious effects of high temperatures much in the same way as is the porous burner panel. Screens are commonly made from refractory metals such as Nichrome® and Inconel®. In some cases the screens are treated with oxidation protection coatings such as pack aluminization to allow them to operate at higher temperatures for extended time periods.

Because some components of a radiant burner system are designed to operate at different temperatures than other parts and may be constructed from different materials, thermally-induced mechanical stresses are usually generated during operation of the burner. Depending upon how the various components and sub-assemblies of the burner are attached to one another, these stresses may produce physical distortion of the burner parts. Particularly vulnerable is the reverberatory screen. Attachment plans have been developed over the years in an effort to minimize the degree of stress and distortion. Some of these schemes are rather complex, requiring numerous pieces which adds to cost. Eventually, however, metal reverberatory screens become thermally distorted (e.g., from creep deformation) and have to be replaced. Often, these radiant burners are designed and operated such that screens are sacrificed to preserve the porous burner panel, which is considerably more difficult to replace.

In addition to the stress-induced distortion problem, there are other limitations of metallic burner hot-stage components. Specifically, such components are oxidation-prone. Oxidized metal tends to be brittle. Also, the oxidized layer may not be adherent to the underlying metal. The higher the temperature, the more rapidly the oxidation reactions proceed. Thus, even though increasing the operating temperature would increase the thermodynamic efficiency of the burner, the chemical and mechanical limitations of metals impose a cap on the practical operating temperature of the radiant burner.

SUMMARY OF THE INVENTION

The present invention addresses these shortcomings in the existing radiant burners.

Specifically, it is an object of the present invention to provide a reverberatory screen or grid which has a high efficiency in terms of its radiant output and conversion of convective and conductive energy to radiant energy.

It is an object of the present invention to provide a reverberatory screen or grid for a radiant burner which can be operated at higher temperatures than metal screens.

It is an object of the present invention to provide a reverberatory screen or grid which is oxidation resistant.

It is an object of the present invention to provide a reverberatory screen or grid which is less susceptible to thermally induced stresses and mechanical distortions than existing screens or grids.

It is an object of the present invention to provide a reverberatory screen or grid which is rugged, yet attaches to the rest of the burner assembly with a minimum of hardware.

According to one aspect of the present invention, many of the above limitations of the prior art are addressed by imparting an aspect of three-dimensionality (e.g., topography) to an otherwise flat, two-dimensional reverberatory burner screen. This third dimension may take the form of bubbles, dimples, corrugations, etc. In its simplest embodiment, the corrugations (e.g., waves or ripples) are sinusoidal in shape and are oriented in a single direction. Further in accordance with the present invention, many of the prior art limitations are addressed by fabricating the burner screens or grids from ceramic matrix composite (CMC) material. In a preferred embodiment, the CMC material comprises a ceramic matrix reinforced with continuous fibers, preferably ceramic fibers. The combination of these two improvements produces a particularly good reverberatory screen—the corrugated CMC screen. The corrugated CMC reverberatory screen represents a substantial improvement over the prior art metal screens in that the screen of the present invention can operate at higher temperature with less oxidation, creep and thermally induced distortion.

Without wishing to be bound by any particular theory or explanation, it appears that the act of corrugating the screen increases the mechanical rigidity of the screen which in turn reduces the number of spatial dimensions (e.g., degrees of freedom) in which mechanical distortion may occur. Specifically, the screen is strengthened or reinforced in all directions except those which are parallel or nearly parallel to the corrugation direction. Corrugating the screen in more than one direction, however, reinforces the screen in all directions within the plane defined by the corrugation directions.

The use of continuous fiber CMCs as a reverberatory screen material can boost the operating temperature and useful lifetimes of these burner assemblies. Whereas metallic screens are limited to about 1000° C., the CMC screens of the present invention can operate continuously for thousands of hours at temperatures up to 1200° C. if designed to minimize the effects of thermomechanical stress. For example, the thermal expansion coefficient of a silicon carbide matrix, CMC screen is about one-half that of commonly used metal screens and in itself, greatly reduces the effects of thermomechanically-induced stresses.

Another factor which influences the life of the reverberatory screen is its geometry, specifically the kind and location of reinforcements. In particular, thermal cycle testing shows increases in the life of the CMC reverberatory screen where at least one edge and/or the attachment region is reinforced with additional CMC material. The greatest lifetime increase, however, is found when the CMC reverberatory screen is corrugated.

An unexpected and surprising benefit of forming the screen into a corrugated sheet is that it has a higher radiant output than flat screens of similar size. The increased radiant output perhaps occurs because the corrugations yield a higher surface area available to radiate than a flat screen. When the screen is mounted vertically, the radiant output of the screen is maximized. Although not wishing to be bound by theory, this is believed to result from hot gasses getting trapped within the corrugations, imparting their thermal energy to the screen which is then subsequently released as radiant energy.

Definitions

"Ceramic Matrix Composite" or "CMC" or "Ceramic Composite Body", as used herein, means a material comprising a two or three dimensionally reinforced ceramic which embeds or encapsulates a preform or filler material comprising a reinforcement material, and may further include unintended additions, such as impurity materials and/or purposeful additions intentionally added to fulfill a particular function (e.g., oxygen scavenging).

"Chemical Vapor Deposition" or "CVD", as used herein, means the chemical reaction of at least one vapor-phase reactant in a reactor to form at least one reaction product which is deposited on a substrate as a solid.

"Chemical Vapor Infiltration" or "CVI", as used herein, means a type of chemical vapor deposition in which the substrate is permeable or porous, whereby the solid reaction product may be deposited on all surfaces of the substrate accessible to the vapor phase, not just the bulk surface.

"Continuous Fiber" or "Continuous Filament", as used herein, means a fiber or filament whose length is at least about 1000 times greater than its diameter.

"Fabric" or "Woven Fabric", as used herein, refers to the body formed by weaving ligaments in an interlocking fashion. The fabrics of the present invention feature a regular repeating pattern and are substantially two dimensional, but could be shaped to form a three dimensional structure, e.g., a tube.

"Ligament", as used herein, refers to the substantially one dimensional body which is woven with other such bodies to form a fabric. A ligament thus may be a single fiber strand or a tow of fibers.

"Refractory Material", as used herein, means a material capable of performing its function in air at a temperature of at least 800° C. for a reasonable period of time.

"Screen" or "Grid", as used herein, means a substantially two dimensional reticulated or skeletal structure which is placed in front of a radiant burner for the purpose of increasing the radiant efficiency of the burner.

"Screen Element" or "Rib" as used herein, is the name of a segment when the reticulated structure takes the form of a regular array, e.g., a screen.

"Segment" or "Skeletal Segment", as used herein, refers to the smallest portion of a reticulated structure which defines a complete side or surface of an opening in the reticulated structure.

"Tow" or "Fiber Tow", as used herein, means a plurality of continuous fibers oriented substantially parallel to one another and at least loosely joined to one another.

DETAILED DESCRIPTION OF THE INVENTION AND PREFERRED EMBODIMENTS

According to the present invention, many of the previously mentioned limitations of the prior art are addressed by imparting a topography to an otherwise flat, two-dimensional reverberatory burner screen. Such topographic character may express itself in the form of bubbles, dimples, corrugations, etc. In its simplest form, the corrugations are sinusoidal in shape and are oriented in a single direction. Further in accordance with the present invention, many of the prior art limitations are addressed by fabricating the burner screens or grids from ceramic matrix composite (CMC) material. In a preferred embodiment, the CMC material comprises a ceramic matrix reinforced with continuous fibers. The combination of these two themes produces a particularly good reverberatory screen—the corrugated CMC screen. The corrugated CMC reverberatory screen represents a substantial improvement over the prior art metal screens in that the screen of the present invention can operate at higher temperature with less oxidation, creep and thermally induced distortion.

Figure 1:
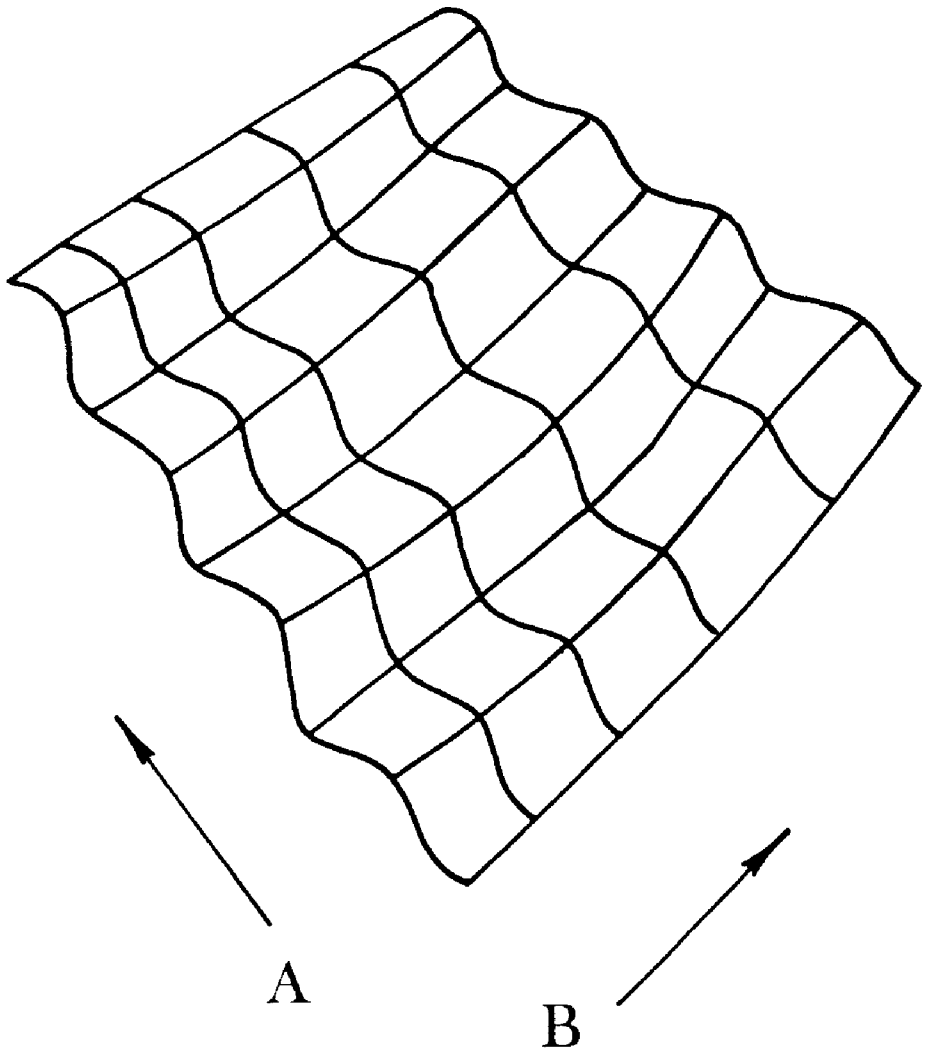
FIG. 1 illustrates a reverberatory screen for a radiant burner corrugated in one direction.

Without wishing to be bound by any particular theory or explanation, it appears that the act of corrugating the screen increased the mechanical rigidity of the screen which in turn reduces the number of spatial dimensions (e.g., degrees of freedom) in which mechanical distortion may occur. Specifically, the screen is strengthened or reinforced in all directions except those which are parallel or nearly parallel to the corrugation direction. The greatest degree of strengthening, of course, occurs in a direction orthogonal to the corrugation direction (see FIG. 1). Corrugating the screen in more than one direction, however, reinforces the screen in all directions within the plane defined by the corrugation directions.

An unexpected and surprising benefit of forming the screen into a corrugated sheet is that it has a higher radiant output than flat screens of similar area. This increased radiant output might occur because the corrugations have a higher surface area available to radiate. Hot gasses are trapped within the corrugations imparting their thermal energy to the CMC screen which is then subsequently released as radiant energy.

As mentioned above the screen elements or ribs making up the reverberatory screens of the present invention are desirably made from ceramic matrix composite (CMC) material. The use of continuous fiber CMCs as a reverberatory screen material can boost the operating temperature and useful lifetimes of these burner assemblies, particularly when the reinforcing fibers are able to debond from the surrounding matrix material. Whereas metallic screens are limited to about 1000° C., the CMC screens of the present invention can operate continuously for thousands of hours at temperatures up to 1200° C. if designed to minimize the effects of thermomechanical stress. The thermal expansion coefficient of a CMC screen featuring silicon carbide as the matrix material is about half that of commonly used metal screens and in itself, greatly reduces the effects of thermomechanically-induced stresses. The CMC fiber, debond interface and matrix can be selected from choices available to those skilled in the art.

Figure 2:
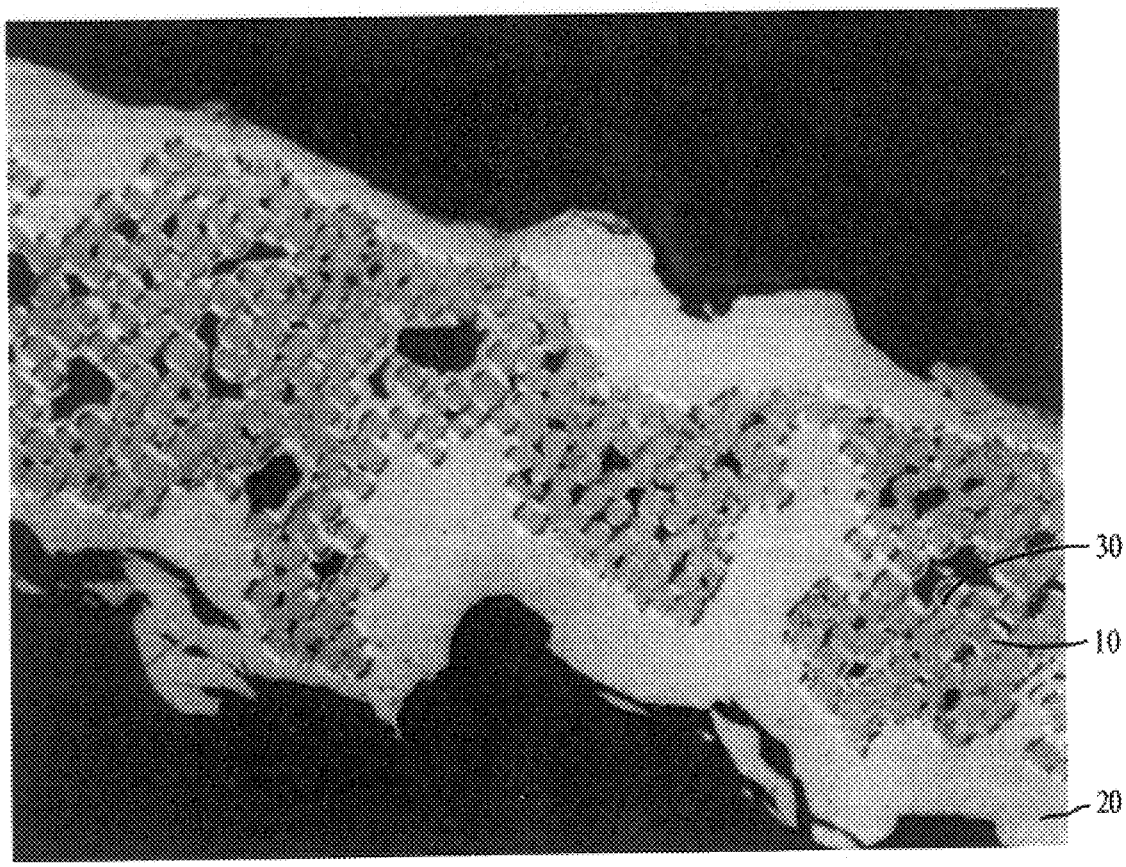
FIG. 2 is an approximately 150× photomicrograph of a polished cross-section of CMC screen material of the present invention produced substantially in accordance with Example 1.

Particularly, with reference to FIG. 2, the CMCs of the present invention comprise fibers 10 embedded by a ceramic matrix 20 and having at least one coating 30 on the fiber or at least some kind of layer disposed between the fiber and the matrix which serves to prevent strong bonds from developing between the fiber and matrix. Under an applied shear stress, the fibers will then debond from the matrix before the matrix cracks. Thus, when loaded to the failure point of the matrix, the fibers are able to pull out of the matrix without catastrophic failure, thereby absorbing fracture energy. In this way the mechanical toughness (or overall durability) of the CMC material is enhanced. Such toughness is an important feature of the present CMC reverberatory screens because, as stated earlier, mechanical stresses are induced in the screen material during thermal cycling. Additionally, because reverberatory screens typically feature a rather low cross-sectional area, the forces associated with normal handling manifest themselves in the CMC material as a large mechanical stress.

Although almost any nonmetallic fiber may be suitable in unison with the CMC's of the present invention, the preferred fibers include carbon, aluminum oxide, alumina silicates and silicon carbide. Particularly preferred are silicon carbide based fibers produced by Nippon Carbon Company Ltd. (Tokyo, Japan) and distributed in the U.S. by Dow Corning Corporation, having the brand names Nicalon® and Hi-Nicalon®, and those distributed by Ube Industries under the brand name Tyranno®. For purposes of the present invention, carbon fiber is considered to be a ceramic fiber.

In fabricating the reverberatory screens of the present invention, the ceramic fibers are typically woven to the desired shape and size and then placed within a mold (typically made from graphite) for subsequent processing. The purpose of the graphite mold is to impart corrugations to the woven ceramic fiber and to temporarily rigidize the woven fibers until they can be rendered self-supporting. One or more coating materials are then applied. In a preferred embodiment, the one or more coatings render the woven ceramic fibers self-supporting. Usually, at least one of the coatings is a debond coating material, described in more detail below.

To further enhance the oxidation resistance of the ceramic matrix composite and particularly of the fibrous components, an oxygen scavenger or getterer may be applied, such as taught by U.S. Pat. No. 5,094,901 to Gray (hereinafter referred to as the "Gray Patent"). In one embodiment the oxygen scavenging layer may be provided in the form of a slurry of particulate in a resin vehicle which may be dip coated, painted, spray coated, etc. onto the fibrous components. In a preferred embodiment the oxygen scavenging material comprises boron carbide particulate. U.S. Pat. No. 5,580,643 to Kennedy et al. also discloses the concept of oxygen gettering as an oxidation protection mechanism. The oxygen getterer material may be applied adjacent to the ceramic fiber, adjacent to the ceramic matrix or within the debond layer. Further, the Kennedy et al. Patent also discloses other oxidation protection mechanisms such as barrier coatings (e.g., SiC) which may be coated over the fibers, debond layer(s) and/or oxygen getterer materials to retard or halt the ingress of deleterious substances (e.g., oxygen) to the fibers, particularly to non-oxide fibers. The entire disclosures of these two U.S. patents are incorporated herein by reference.

One or more debond coatings, typically, are applied to the ceramic fibers prior to encapsulation by the ceramic matrix. Of course, any suitable material may be used; however, the preferred debond coatings include pyrolytic carbon, resin char carbon and boron nitride. In a preferred embodiment the debond coatings are applied by means of chemical vapor infiltration (CVI), although any technique which can apply coatings having a relatively uniform thickness ranging from about 0.01 micron to about 1 to 2 microns may be considered. The one or more debond coatings may be applied either before or after the oxygen scavenging materials are applied. In certain instances, the debond material also acts as an oxygen scavenger (e.g., BN). In a further preferred embodiment when the oxygen scavenging material is applied by means of a particulate slurry, it is preferable to apply the slurry to the fiber weave first, and then the debond layer(s). The discontinuous nature of the particulates will not interfere to any substantial extent with the operation of the debond mechanism. It is not even necessary to coat individual fibers with the oxidation protection and debond materials; encapsulation of an entire fiber tow by these materials and the matrix material still yields a functional reverberatory screen.

The ceramic fibers, debond coatings and any oxygen scavenger materials or oxidation protection coatings are then encapsulated in a ceramic matrix material. Preferred materials for the ceramic matrix include aluminum oxide, silicon nitride and silicon carbide. The preferred means of forming the matrix is again by CVI although other processing techniques such as sintering, reactive sintering, melt infiltration, directed metal oxidation, etc. may also work. The preferred CVI technique for forming the matrix of a ceramic matrix composite material is well known to those skilled in the art. A silicon carbide matrix, for example, may be formed by decomposing methyl trichlorosilane (MTS) in the presence of excess hydrogen at a temperature of about 1000° C. and a pressure of about 20 torr. A ceramic matrix comprising silicon nitride and/or silicon carbide may be produced by infiltrating a liquid silazane polymer such as CERASET™ SN inorganic polymer (Lanxide Corp., Newark, Del.) into the permeable mass of reinforcement material and pyrolyzing the polymer. Several infiltration/pyrolysis cycles may be required to achieve the desired density. The above-mentioned directed metal oxidation process for producing ceramic or ceramic composite bodies is illustrated in U.S. patent application Ser. No. 08/451,581 to Newkirk et al., filed on May 26, 1995 (now allowed), which was a continuation-in-part of U.S. Pat. No. 5,420,085. According to the Newkirk et al. Application, whose entire disclosure is incorporated herein by reference, a body of molten metal may be caused to oxidize in such a way that the molten metal wets its just-formed oxidation reaction product and wicks through fissures in the latter to come in contact and react with fresh vapor-phase oxidant to produce additional oxidation reaction product, thereby continuously developing a polycrystalline ceramic structure comprising the oxidation reaction product and the metal in the fissures. A permeable mass may be placed in the path of the developing polycrystalline structure. The permeable mass comprises at least one filler material which is substantially non-reactive with respect to the molten metal and oxidant. The body formed is then a ceramic composite body comprising the filler material embedded by the above-mentioned polycrystalline ceramic material. When a permeable mass is employed, a solid or liquid oxidant may be placed in the mass, in lieu of or in addition to the vapor-phase oxidant.

Figure 3:
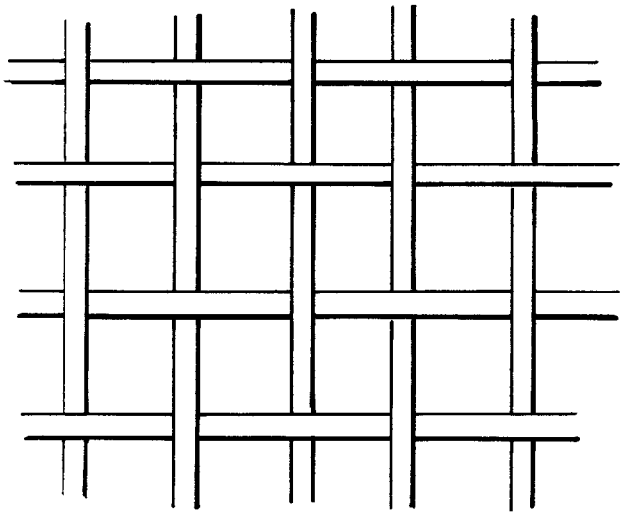
FIG. 3 illustrates a plain weave of fiber tows such as might be used to make the present refractory reverberatory screens.

As mentioned above, the basis of the CMC reverberatory screens of the present invention is a fiber reinforcement, preferably ceramic fiber woven in such a way as to form a mesh having openings through which oxygen (typically in the form of air) can enter and combustion gases can exit the combustion zone. A convenient form of the ceramic fiber is that of a continuous fiber tow. In a preferred embodiment the fiber tow comprises several hundred silicon carbide based fibers, each fiber having a diameter of about 10–25 microns. The continuous fiber tow is then cut to form a plurality of tows of some desired length. The tows are then woven by any method with which those skilled in the art are familiar to form a mesh, screen or grid structure such as shown in FIG. 3. This figure specifically shows the tows woven in the form of a plain weave, although other weaves such as a harness satin weave may also be employed. In a harness satin weave any particular fiber tow will pass over or under more than one other fiber tow before moving back up or below the plane of the weave. In the present invention, a plain weave is used for convenience. Specifically, the plain weave screen is easily formed to a desired shape (such as by corrugating) without distorting or shifting individual fiber tows. In a preferred embodiment the fiber tows are woven orthogonally with respect to one another although again, such a weave is for convenience and different weaves having angles other than 90° are also suitable for use in the present invention.

If corrugating is to be performed, this operation takes place once the basic screen or grid shape has been woven, and while the woven screen is still pliable. In the case of a refractory metal screen, the corrugations may be imposed by a stamping or rolling operation. For screens made of ceramic fiber, the corrugations preferably are imposed on the woven fiber sheet when the sheet is placed into dies or tools for subsequent processing, specifically to apply the one or more debond and/or oxidation protection coatings. As the following examples will show, various reverberatory screens have been prepared having various corrugated forms. Specifically, reverberatory screens have been fabricated having a corrugation periodicity (distance between wave peaks or troughs) ranging from about one centimeter (1 cm) to about two centimeters (2 cm). At least at the short end of the periodicity range it appears that the periodicity of the corrugation may be limited only by the ability of any ceramic fibers present to be bent without breaking.

Figure 4:
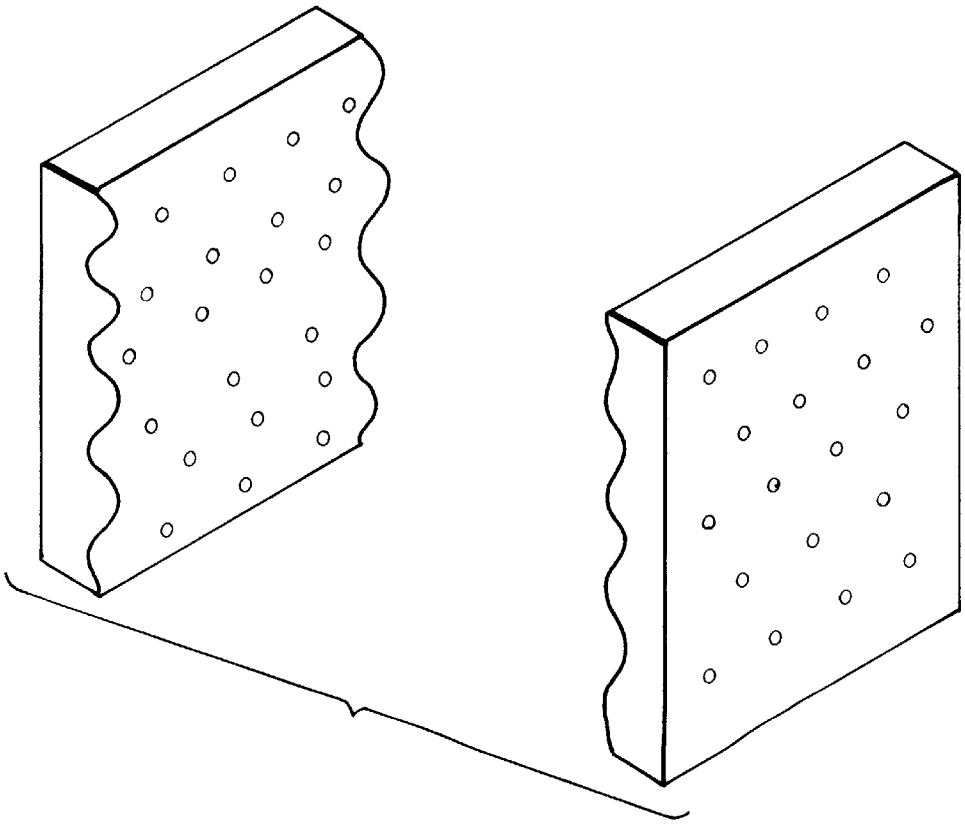
FIG. 4 illustrates in isometric view a two piece mold featuring a corrugated face thereof for supporting the screen material during thermal processing.
Figure 5:
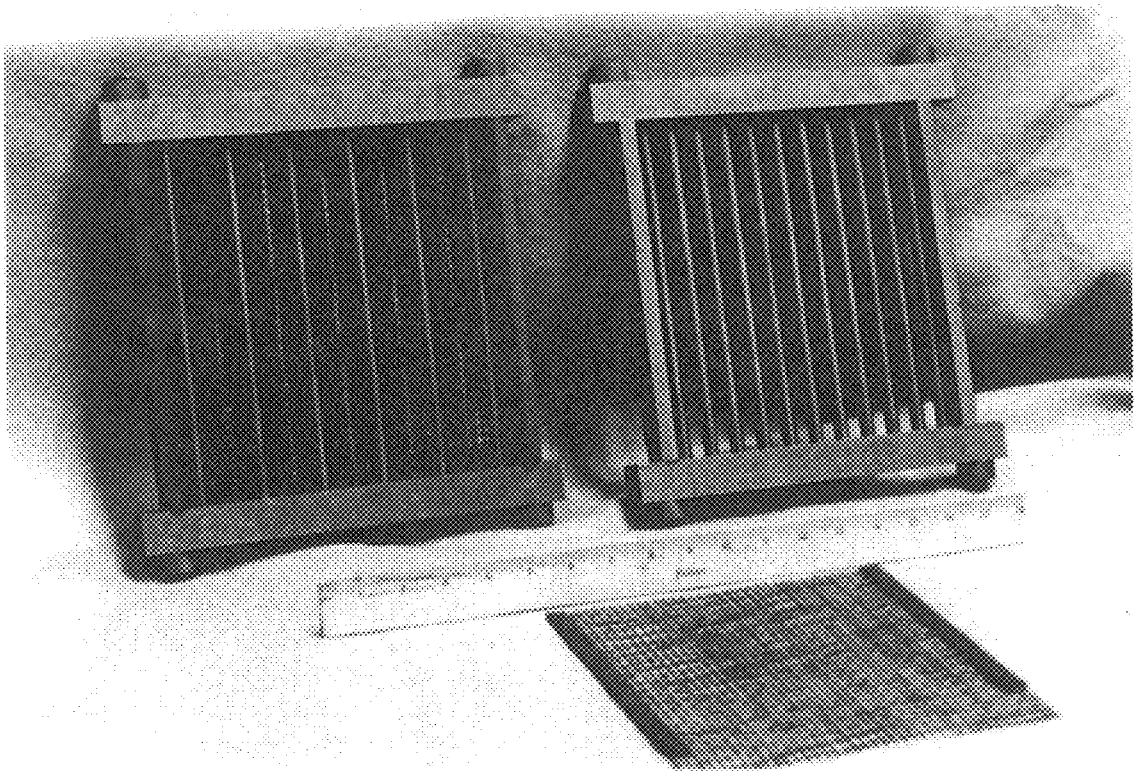
FIG. 5 illustrates an alternate design for such screen support tooling.

Two different designs of molds for imposing a corrugation onto the ceramic reverberatory screen are shown in FIGS. 4 and 5. FIG. 4 in particular shows the two halves of a clamping-type graphite mold. A plurality of small holes are drilled through both halves of the mold to permit access of the reactant gases to the woven ceramic fabric during chemical vapor infiltration. As suggested by the corrugations on the interior faces of the mold, the ceramic fabric is contacted against the corrugations and the complimentary mold half is pressed against the ceramic fabric and clamped or bolted (not shown in Figure) to the opposite mold half.

FIG. 5 shows a different type of graphite fixturing in which the ceramic fabric is passed on alternate sides of adjacent dowel rods and clamped to the sides of the graphite tool. As mentioned earlier, once the debond and/or oxidation protection coatings have been applied, the woven ceramic fabric typically becomes self-supporting. At this point it becomes possible and sometimes convenient to remove the coated fabric from the mold or dies for further processing, such as for matrix deposition.

Figure 6A:
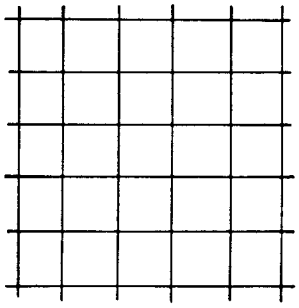
FIGS. 6A and 6B illustrate a reverberatory screen or grid featuring a regular array and a random reticulated arrangement of screen segments, respectively.
Figure 6B:
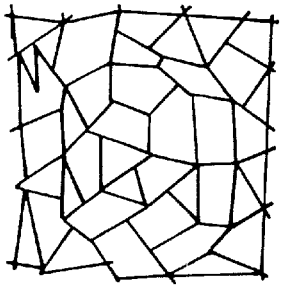

Although most of the discussion up to this point has been concerned with the CMC embodiment, when the embodiment comprises a corrugated metal screen or grid, the screen or grid does not have to feature the regular array or pattern usually associated with a woven fabric (i.e., a woven fabric of metal wire). Instead, the metal screen may comprise a reticulated metal skeletal structure such as that shown in FIG. 6B. Unlike the orderly array suggested by the grid of FIG. 6A, the reticulated grid structure of FIG. 6B features more or less randomly oriented segments. To simplify the drawing and presentation of subject matter, the corrugations have been removed from each of these figures.

Figure 7A:
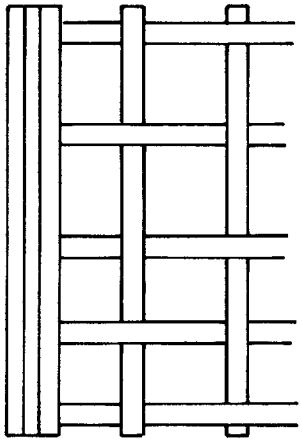
FIGS. 7A and 7B illustrate two different styles of fiber tow reinforcement for the present reverberatory screens.
Figure 7B:
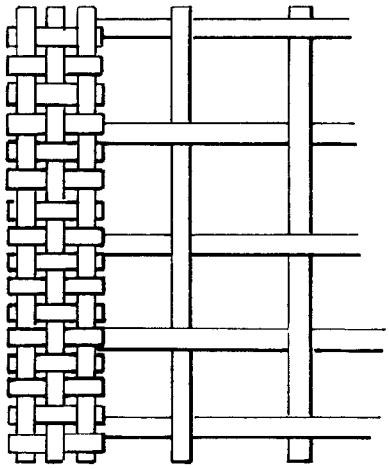
Figure 8:
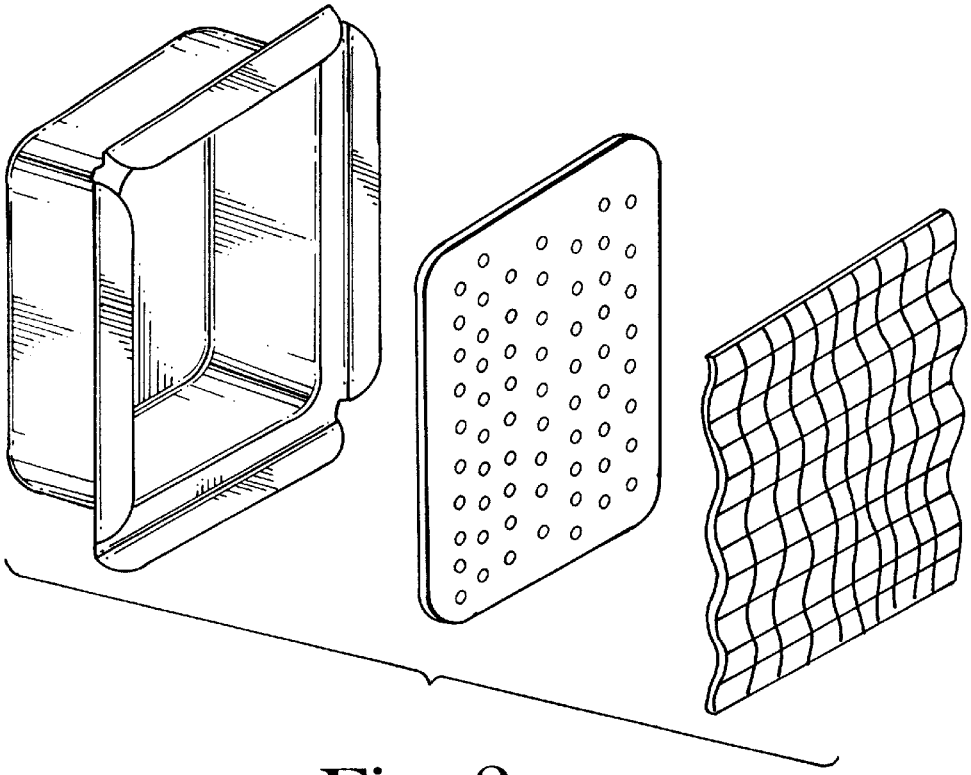
FIGS. 8 illustrates the placement and orientation of a corrugated reverberatory screen according to the present invention in relation to the porous burner plate and the plenum chamber of a typical radiant burner rig.

In a preferred embodiment of the present invention the ceramic reverberatory screens are reinforced along at least one edge thereof. In one such embodiment (see for example, FIG. 7A) the reinforcement takes the form of several (e.g. 3 to 8) parallel fiber tows temporarily affixed to one edge of the woven ceramic fabric using, for example, an acrylic or phenolic resin. The fiber tows are placed edgewise with respect to one another with as little space as possible between adjacent tows. In another embodiment (FIG. 7B)

strips of tightly woven plain weave fabric are cut in one to two centimeter widths (and length to suit) and temporarily affixed to one or more edges of the open mesh ceramic fabric using an appropriate binder for the processing conditions. Again, once the debond and/or oxidation protection layers have been deposited onto the fabric, the fabric typically becomes self-supporting and the reinforcement strips bond to the rest of the fabric screen. Further, most organic binders used for temporary rigidizing are removed through subsequent thermal processing (such as during the coating depositions), most commonly through volatilization. The reinforcement strips may be placed along each edge of the reverberatory screen, but at a minimum at least one should be placed along a corrugated edge, e.g., an edge featuring a corrugated structure. An illustration of such a reinforcement is shown in FIG. 8. It may also be desirable to reinforce the attachment points or areas especially if the overall screen is not reinforced through corrugating.

Figure 9:
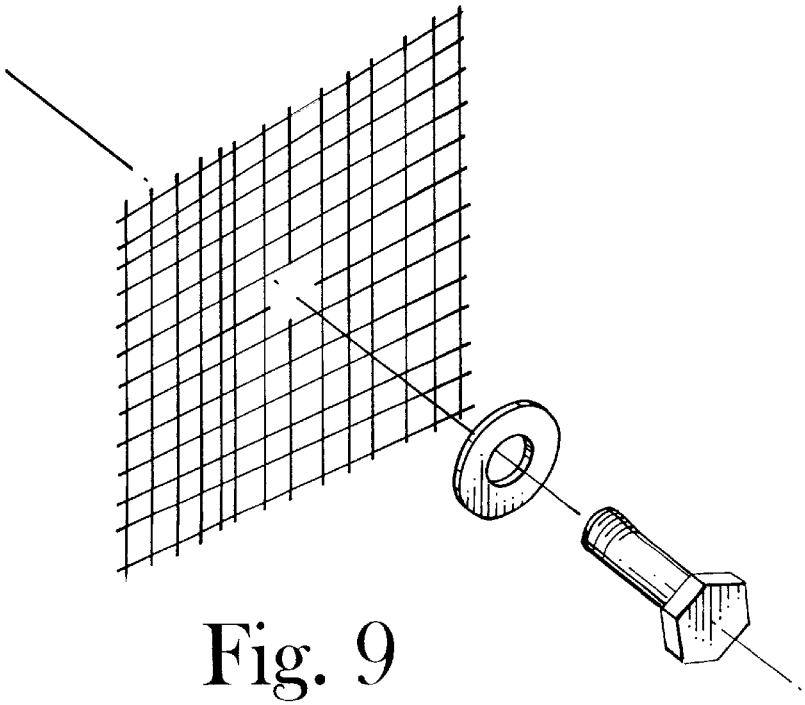
FIG. 9 illustrates a means for attaching the reverberatory screen of Example 1 to the rest of the radiant burner for subsequent test purposes.

FIG. 8 suggests that the reverberatory screen is attached and supported along its edges. Although a multitude of attachment scenarios are possible, the reverberatory screen of the present invention preferably is mounted to the rest of the radiant burner unit substantially as shown in FIG. 9. Specifically, the screen is attached at or near its center by means of a bolt and a large washer, preferably insulating, to distribute the load over as large an area as practical. Due to the light weight of the screen, the bolt does not have to be torqued to any great degree to hold the screen in place. If necessary to accommodate the bolt, one or more screen elements may be removed.

The following Examples further illustrate the present invention.

EXAMPLE 1

Silicon carbide fiber tow (15–20 micron diameter filaments, 1800 denier Nicalon®, Nippon Carbon Co., Ltd., Tokyo, Japan) was woven to form an open plain weave fabric having 1.8 ends per cm. The fabric had an open area of about 50 percent. The fabric was then impregnated with a mixture of polymethylmethacrylate resin and boron carbide particulate oxidation inhibitor (2–3 microns average particle size) as taught by the Gray Patent. The impregnated open weave cloth was then formed into a corrugated shape in a graphite tool. The corrugations were almost 1 cm high by about 1 cm wide.

The tooled screen was placed into a low pressure chemical vapor infiltration (CVI) reactor having a deposition chamber measuring about 1.4 meters in diameter by about 2 meters long. Methane was fed into the reactor at a flow rate of about 15 standard liters per minute (slpm), a low pressure (less than 100 torr) and 1000° C. to deposit an approximately 0.5 micron thick pyrolytic carbon debond interface on the fiber and particle surfaces. The screen was then placed into another CVI reactor designed to deposit SiC from a mixture of methyl trichlorosilane (MTS) and hydrogen at about 1000° C. at reduced pressure of about 250 torr. This reactor chamber for the SiC deposition measured about 0.4 meters in diameter by about 2.4 meters in length. The MTS was carried into the reactor by diverting about 1.8 slpm of the hydrogen gas (out of a total $H_2$ flow rate of about 11 slpm) into a bath of liquid MTS maintained at a temperature of about 45°C. The resulting CVI SiC operation produced a SiC coating on the particles and on the fibers which was about 10–100 microns thick. The screen was thus rendered durable and free-standing.

To test its efficacy, the completed screen was placed over the top of a commercially available (Alzeta Co., Santa Clara, Calif.) porous metal mat burner with a spacing of about 1 cm between the metal mat and the corrugations. Both the screen and mat burner were oriented vertically. The radiant output was measured with a calorimeter normal to the burner surface. Heat flux measurements were taken with and without the screen at constant fuel-air flow conditions. The measured radiant output of the mat burner was approximately 35 percent higher when the screen was installed over the mat burner than when the screen was absent.

The thermomechanical durability of the screen was evaluated by repeated on-off cycling of the burner/screen combination. In this case the screen was oriented horizontally to radiate the heat into an exhaust hood. The burner/screen was turned on and off about 18 times per hour. The maximum temperature attained by the screen during this test was about 900–1000° C. while the minimum temperature was in the range of 100–300° C. The screen accrued a total of over 14,000 on-off cycles and about 1000 hours of hot, on time. After the test, the screen was examined. No evidence of distortion, warpage or excessive oxidation was found.

EXAMPLE 2

A screen using fewer, i.e. wider, corrugations of about 2 cm width was fabricated in exactly the same manner as described in Example 1. The completed screen was then tested for radiant output and thermomechanical integrity. The radiant output of the burner with the screen was determined to be about 33 percent higher than that without the screen. This reduced output of two percentage points versus the screen with more corrugations (e.g., the Example 1 screen) was attributed to less surface area available for radiation.

The same screen was thermally cycled in exactly the same manner described in Example 1. After about 4000 on-off cycles, no change was noted in the screen and the test was halted.

EXAMPLE 3

A screen as described in Example 1was fabricated from the same Nicalon® fibers but with a phenolic resin (Grade SC-1008, Borden, Inc., Columbus, Ohio) substituted for the acrylic resin. The purpose of the phenolic resin was to rigidize the fibers into the corrugated shape within the tool upon curing and, at the same time, form a carbonaceous interface on the surface of the fibers. Thus, no CVI reactor was used to deposit a carbon debond layer. Instead, the tooled screen utilizing the phenolic resin was heated to about 1000° C. in an inert atmosphere to convert the resin into glassy carbon. The screen was removed from the tool and placed into the SiC CVI reactor as described in Example 1. On cooling, the completed screen was observed to be rigid and free-standing.

EXAMPLE 4

A corrugated screen was fabricated as described in Example 1. Instead of using pyrolytic carbon as the debond interface, however, the tooled screen preform was placed into a CVI reactor capable of depositing boron nitride from a mixture of ammonia and boron trichloride substantially in accordance with Example 15of the Kennedy et al. Patent. Upon cooling from the run conditions, the screen was observed to be rigid and free standing.

EXAMPLE 5

A corrugated reverberatory screen was fabricated as described in Example 1 with the exception that Nextel® grade 610 aluminum oxide fibers (3M Co., St. Paul, Minn.) were substituted for the Nicalon® SiC fibers and the particulate oxidation inhibitor was omitted.

The resulting screen was observed to be rigid and free standing.

The preceding examples should be considered merely illustrative of the present invention. An artisan of ordinary skill will readily appreciate that many different combinations of materials may be employed without departing from the spirit and scope of the present invention as defined by the appended claims.

What is claimed is:

1. A reverberatory screen for a radiant burner, comprising:

a plurality of ligaments woven together to form an open mesh structure, wherein a ligament comprises at least one ceramic fiber, further wherein a junction or intersection of two or more ligaments defines at least a portion of an opening of said open mesh structure;

a corrugation imposed on said open mesh structure in more than one direction;

a ceramic matrix embedding at least one ligament; and at least one debond material disposed between said ligament and said matrix to permit pull-out of said at least one fiber relative to said matrix upon application of fracture stress to said matrix.

2. The reverberatory screen of claim 1, further comprising providing at least one oxygen scavenger material to the ceramic matrix composite material, the oxygen scavenger material contacting at least one of the fiber, the matrix or the debond material.

3. The reverberatory screen of claim 2, wherein said oxygen scavenger material comprises at least material selected from the group consisting of boron carbide and boron nitride.

4. The reverberatory screen of claim 1, wherein the matrix comprises at least one material selected from the group consisting of silicon carbide, silicon nitride and aluminum oxide.

5. The reverberatory screen of claim 1, wherein said at least one ceramic fiber is selected from the group consisting of silicon carbide, aluminum oxide and aluminosilicates.

6. The reverberatory screen of claim 1, where said debond material comprises a material selected from the group consisting of pyrolytic carbon, resin char carbon, and boron nitride.

7. The reverberatory screen of claim 1, wherein at least one ligament comprises a fiber tow.

8. The reverberatory screen of 1, further comprising reinforcement along an edge of said screen in at least one direction of said corrugation.

9. The corrugated grid of claim 1, wherein a total of said openings comprises from about 30 percent to about 70 percent of the total area bounded by a perimeter of said grid.

10. The reverberatory screen of claim 1, wherein each ceramic fiber comprises a continuous fiber embedded in said ceramic matrix.

11. The reverberatory screen of claim 10, wherein at least a portion of said continuous fibers are provided in the form of a tow, and further comprising at least two sets of fiber tows, each of said tows within each set being substantially parallel to one another.

12. The reverberatory screen of claim 11, wherein said fiber tows of one set contact said fiber tows of another set to form a screen of regularly spaced ligaments and openings therebetween.

13. The reverberatory screen of claim 12, wherein said contacting fiber tows are woven.

14. The reverberatory screen of claim 11, wherein said continuous fibers are about 10 to 25 microns in diameter.

15. The reverberatory screen of claim 11, wherein at least one of said fiber tows comprises more than about 50 fibers.

16. The reverberatory screen of claim 11, wherein said fibers and said ceramic matrix comprise silicon carbide, and said at least one debond material comprises carbon.

17. The reverberatory screen of claim 11, further comprising an oxidation protection material disposed between said fibers and said matrix.

* * * * *